US012366251B2

(12) United States Patent
Ekambaram et al.

(10) Patent No.: US 12,366,251 B2
(45) Date of Patent: Jul. 22, 2025

(54) SEALS FOR ELECTRIC SUBMERSIBLE PUMPS

(71) Applicant: Schlumberger Technology Corporation, Sugar Land, TX (US)

(72) Inventors: Raju Ekambaram, Singapore (SG); Teng Fei Wang, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/547,340

(22) PCT Filed: Feb. 22, 2022

(86) PCT No.: PCT/US2022/017235
§ 371 (c)(1),
(2) Date: Aug. 22, 2023

(87) PCT Pub. No.: WO2022/178389
PCT Pub. Date: Aug. 25, 2022

(65) Prior Publication Data

US 2024/0125220 A1 Apr. 18, 2024

(30) Foreign Application Priority Data

Feb. 22, 2021 (SG) ..... 10202101753Y

(51) Int. Cl.
*F04D 29/08* (2006.01)
*E21B 43/12* (2006.01)
(Continued)

(52) U.S. Cl.
CPC ..... *F04D 29/086* (2013.01); *E21B 43/128* (2013.01); *F04D 13/10* (2013.01); *F04D 29/445* (2013.01); *F04D 29/548* (2013.01)

(58) Field of Classification Search
CPC ..... F04D 13/08; F04D 13/086; F04D 13/10; F04D 29/08; F04D 29/086; F04D 29/44;
(Continued)

(56) References Cited

U.S. PATENT DOCUMENTS 3,851,899 A * 12/1974 Franz ..... H01L 21/00 285/95
6,439,835 B1 * 8/2002 Chien ..... F04D 29/628 415/214.1

(Continued)

FOREIGN PATENT DOCUMENTS

JP 07019350 A 1/1995

OTHER PUBLICATIONS

International Search Report and Written Opinion issued in the PCT Application PCT/US2022/017235, dated Jun. 2, 2022 (12 Pages).

*Primary Examiner* — Nathan C Zollinger
*Assistant Examiner* — Chirag Jariwala
(74) *Attorney, Agent, or Firm* — Jeffrey D. Frantz

(57) ABSTRACT

Electric submersible pump systems, and more particularly, seals for ESPs, are provided. An electric submersible pump includes a plurality of impellers; a plurality of diffusers; at least one sealing ring positioned axially between two consecutive diffusers of the plurality of diffusers; and at least one O-ring positioned axially between the at least one sealing ring and a lower of the two consecutive diffusers.

12 Claims, 4 Drawing Sheets

(51) Int. Cl.
*F04D 13/10* (2006.01)
*F04D 29/44* (2006.01)
*F04D 29/54* (2006.01)

(58) Field of Classification Search
CPC ..... F04D 29/445; F04D 29/448; F04D 29/60; F04D 29/605; F04D 29/606; F04D 29/607; F04D 29/62; F04D 29/622; F04D 29/628; F04D 29/40; F04D 29/406; F04D 29/54; F04D 29/548; E21B 43/12; E21B 43/121; E21B 43/128; E21B 33/10; E21B 33/1208; E21B 2200/01; F16J 15/002; F16J 15/02; F16J 15/021; F16J 15/022; F16J 15/028
USPC ..... 285/351
See application file for complete search history.

(56) References Cited

U.S. PATENT DOCUMENTS

| | | | | |
|---|---|---|---|---|
| 8,043,051 | B2 * | 10/2011 | Brunner | F04D 1/063 415/170.1 |
| 8,944,168 | B2 | 2/2015 | Pettigrew | |
| 2008/0292454 | A1 | 11/2008 | Brunner | |
| 2014/0271107 | A1 | 9/2014 | Semple | |
| 2017/0102009 | A1 * | 4/2017 | Johnson | F04D 13/086 |
| 2023/0012388 | A1 * | 1/2023 | Henderson et al. | F04D 13/10 |

* cited by examiner

SEALS FOR ELECTRIC SUBMERSIBLE PUMPS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a national stage entry under 35 U.S.C. 371 of International Application No. PCT/US2022/017235, filed Feb. 22, 2022, which claims priority of Singapore Application No. SG 10202101753Y, filed Feb. 22, 2021, the entirety of which is incorporated by reference herein and should be considered part of this specification.

BACKGROUND

Field

The present disclosure generally relates to electric submersible pumps (ESPs), and more particularly to seals for use in ESPs.

Description of the Related Art

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface.

SUMMARY

In some configurations, an electric submersible pump includes a plurality of impellers; a plurality of diffusers; at least one sealing ring positioned axially between two consecutive diffusers of the plurality of diffusers; and at least one O-ring positioned axially between the at least one sealing ring and a lower of the two consecutive diffusers.

The impellers, diffusers, sealing ring, and O-ring can be disposed in a housing of the electric submersible pump. As the impellers, diffusers, sealing ring, and O-ring are slid into the housing during assembly, a gap is formed axially between a portion of the at least one sealing ring and an upward facing surface of the lower of the two consecutive diffusers. Once the impellers, diffusers, sealing ring, and O-ring are positioned at a desired location within the housing, stage compression is applied, thereby closing the gap such that the sealing ring contacts the upward facing surface of the lower of the two consecutive diffusers and the O-ring becomes compressed against an inner surface of the housing. When the O-ring is compressed against the inner surface of the housing, the O-ring seals against the inner surface of the housing to reduce housing-diffuser annular pressure and therefore stress on the diffusers below the seal. The pump can include a plurality of sealing rings, each positioned axially between two consecutive diffusers, and a plurality of O-rings, each positioned axially between an associated sealing ring and the lower of the two consecutive diffusers between which the associated sealing ring is positioned.

The sealing ring can have a radially inner portion and a radially outer portion. The O-ring is positioned axially between the radially outer portion and the lower of the two consecutive diffusers. A lower surface of the radially inner portion contacts an upward facing surface of the lower of the two consecutive diffusers in use. A lower edge of the radially outer portion can be angled or inclined.

In some configurations, a method of assembling an electric submersible pump includes positioning a sealing ring axially between two diffusers such that a gap is formed axially between the sealing ring and an upward facing surface of a lower diffuser of the two diffusers; positioning an uncompressed O-ring axially between the sealing ring and the lower diffuser of the two diffusers; sliding the diffusers, sealing ring, and O-ring into a housing to a desired position; and applying stage compression to close the gap, thereby compressing the O-ring to create a seal that prevents or inhibits leakage of fluid.

The method can include positioning a plurality of sealing rings each axially between two consecutive diffusers of a plurality of diffusers, positioning a plurality of uncompressed O-rings each axially between an associated sealing ring and the lower diffuser of the two consecutive diffusers between which the associated sealing ring is positioned, and sliding the plurality of diffusers, plurality of sealing rings, and plurality of O-rings into the housing to a desired position.

In some configurations, an electric submersible pump system includes an electric submersible pump, a shaft extending axially through the pump, a protector, and a motor. The pump includes a housing, a plurality of impellers, a plurality of diffusers, and at least one O-ring positioned axially between two consecutive diffusers of the plurality of diffusers.

The system can include at least one sealing ring positioned axially between the two consecutive diffusers of the plurality of diffusers. The at least one O-ring can be positioned axially between the at least one sealing ring and a lower of the two consecutive diffusers. The O-ring can be in an uncompressed state as the impellers, diffusers, sealing ring, and O-ring are slid into the housing during assembly. A gap can be formed axially between a portion of the at least one sealing ring and an upward facing surface of the lower of the two consecutive diffusers during assembly as the impellers, diffusers, sealing ring, and O-ring are slid into the housing during assembly. The sealing ring can contact the upward facing surface of the lower of the two consecutive diffusers and the O-ring can be compressed against an inner surface of the housing when the impellers, diffusers, sealing ring, and O-ring are positioned at a desired location within the housing and stage compression is applied. The sealing ring can have a radially inner portion and a radially outer portion. The O-ring can be positioned axially between the radially outer portion and the lower of the two consecutive diffusers. A lower surface of the radially inner portion can contact an upward facing surface of the lower of the two consecutive diffusers in use.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
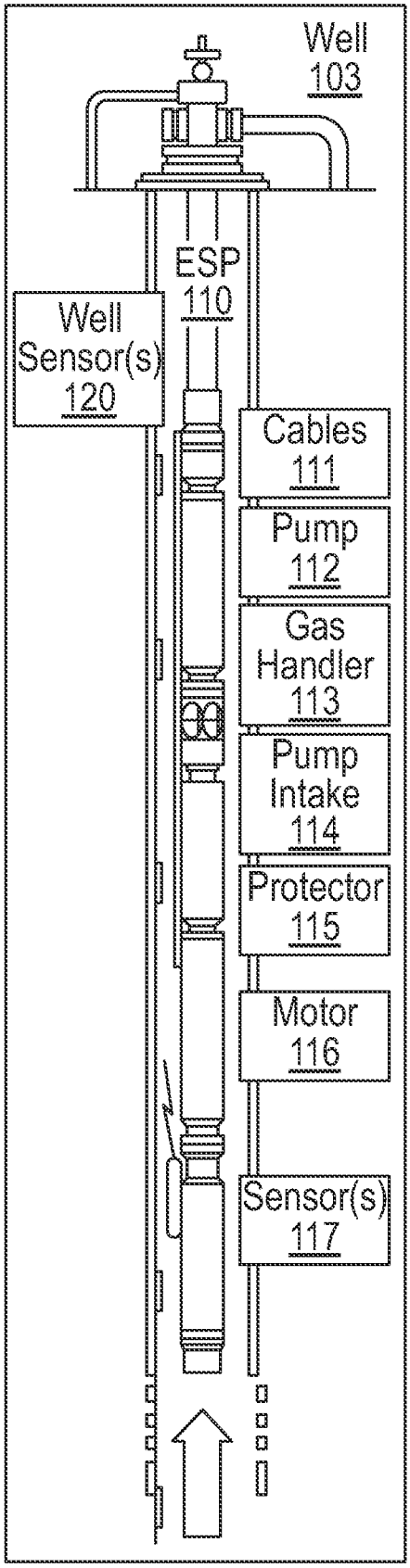
FIG. 1 shows a schematic of an electric submersible pump (ESP) system.

Various types of artificial lift equipment and methods are available, for example, electric submersible pumps (ESP). As shown in the example embodiment of FIG. 1, an ESP 110 typically includes a motor 116, a protector 115, a pump 112, a pump intake 114, and one or more cables 111, which can include an electric power cable. The motor 116 can be powered and controlled by a surface power supply and controller, respectively, via the cables 111. In some configurations, the ESP 110 also includes gas handling features 113 and/or one or more sensors 117 (e.g., for temperature, pressure, current leakage, vibration, etc.). As shown, the well 103 may include one or more well sensors 120.

Figure 2:
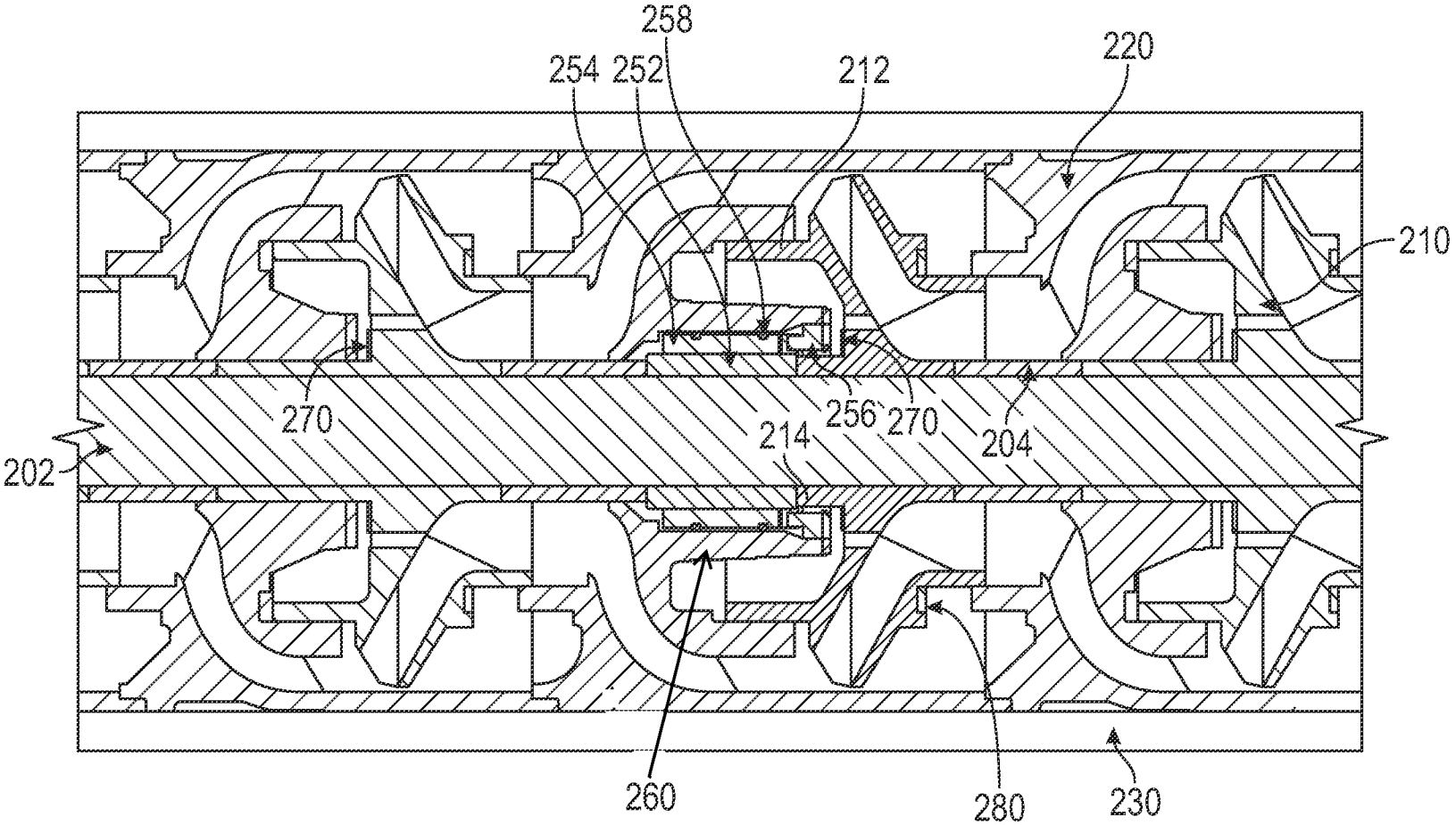
FIG. 2 shows a cross-section of a portion of a pump section of the ESP system of FIG. 1.

The pump 112 includes multiple centrifugal pump stages mounted in series within a housing 230, as shown in FIG. 2. Each stage includes a rotating impeller 210 and a stationary diffuser 220. One or more spacers 204 can be disposed axially between sequential impellers 210. A shaft 202 extends through the pump 112 (e.g., through central hubs or bores or the impellers 210 and diffusers 220) and is operatively coupled to the motor 116. The shaft 202 can be coupled to the protector 115 (e.g., a shaft of the protector), which in turn can be coupled to the motor 116 (e.g., a shaft of the motor). The impellers 210 are rotationally coupled, e.g., keyed, to the shaft 202. The diffusers 220 are coupled, e.g., rotationally fixed, to the housing 230. In use, the motor 116 causes rotation of the shaft 202 (for example, by rotating the protector 115 shaft, which rotates the pump shaft 202), which in turn rotates the impellers 210 relative to and within the stationary diffusers 220.

In use, well fluid flows into the first (lowest) stage of the ESP 110 and passes through an impeller 210, which centrifuges the fluid radially outward such that the fluid gains energy in the form of velocity. Upon exiting the impeller 210, the fluid makes a sharp turn to enter a diffuser 220, where the fluid's velocity is converted to pressure. The fluid then enters the next impeller 210 and diffuser 220 stage to repeat the process. As the fluid passes through the pump stages, the fluid incrementally gains pressure until the fluid has sufficient energy to travel to the well surface.

As shown in FIG. 2, a bearing assembly can be disposed between, e.g., at least partially radially between, the shaft 202 and a diffuser 220 and/or between, e.g., at least partially axially between, an impeller 210 and its associated diffuser 220. A portion of the diffuser 220 can act as a bearing housing 260. In the illustrated embodiment, the bearing assembly includes a bearing sleeve 252 disposed about the shaft 202 and a bushing 254 disposed about the bearing sleeve 252 and radially between the bearing sleeve 252 and a portion of the diffuser 220. One or more o-rings 258 can be disposed about the bushing 254, for example, radially between the bushing 254 and the diffuser 220 or bearing housing 260.

The illustrated bearing assembly also includes an anti-rotation upthrust ring 256 disposed about the bearing sleeve 252. As shown, the anti-rotation upthrust ring 256 can be disposed adjacent an upstream end of the bushing 254. The bearing sleeve 252 is keyed or rotationally coupled to the shaft 202 such that the bearing sleeve 252 rotates with the shaft 202 in use. The anti-rotation upthrust ring 256 prevents or inhibits the bushing 254 from rotating such that the bushing 254 is stationary or rotationally fixed relative to the diffuser 220. The anti-rotation upthrust ring 256 can also help prevent or inhibit axial movement of the bushing 254 and/or the bushing 254 from dropping out of place from the bearing housing 260. In use, the bearing assembly can help absorb thrust and/or accommodate the rotation of the shaft relative to the diffuser.

The pump 112 can also include one or more thrust assemblies, for example, upthrust assemblies and/or downthrust assemblies, disposed axially between portions of and/or operatively connecting an impeller 210 and its associated diffuser 220. A thrust assembly can include a thrust washer and a thrust pad, which may be a portion of the impeller 210 or diffuser 220. In the configuration of FIG. 2, an upthrust washer 270 is disposed on, adjacent, or proximate an upper surface, or upwardly facing surface, of the impeller 210. In the illustrated configuration, the upthrust washer 270 is positioned adjacent a central hub 214 or portion of the impeller 210 having a bore through which the shaft 202 extends and radially between the hub 214 and a balance ring 212 of the impeller 210. In use, the illustrated upthrust washer 270 contacts the anti-rotation upthrust ring 256 when the pump 112 is operating in an upthrust condition, for example, during HPTS testing at a wide open condition, improper or over shimming at a well site, and/or operating beyond maximum operating range in the field. In some configurations, the pump 112 also includes one or more downthrust assemblies. In the configuration of FIG. 2, a downthrust washer 280 is disposed on or adjacent a lower, or downwardly facing surface, of the impeller 210, and is disposed axially between a portion of the impeller 210 and a portion of an adjacent diffuser 220.

Figure 3:
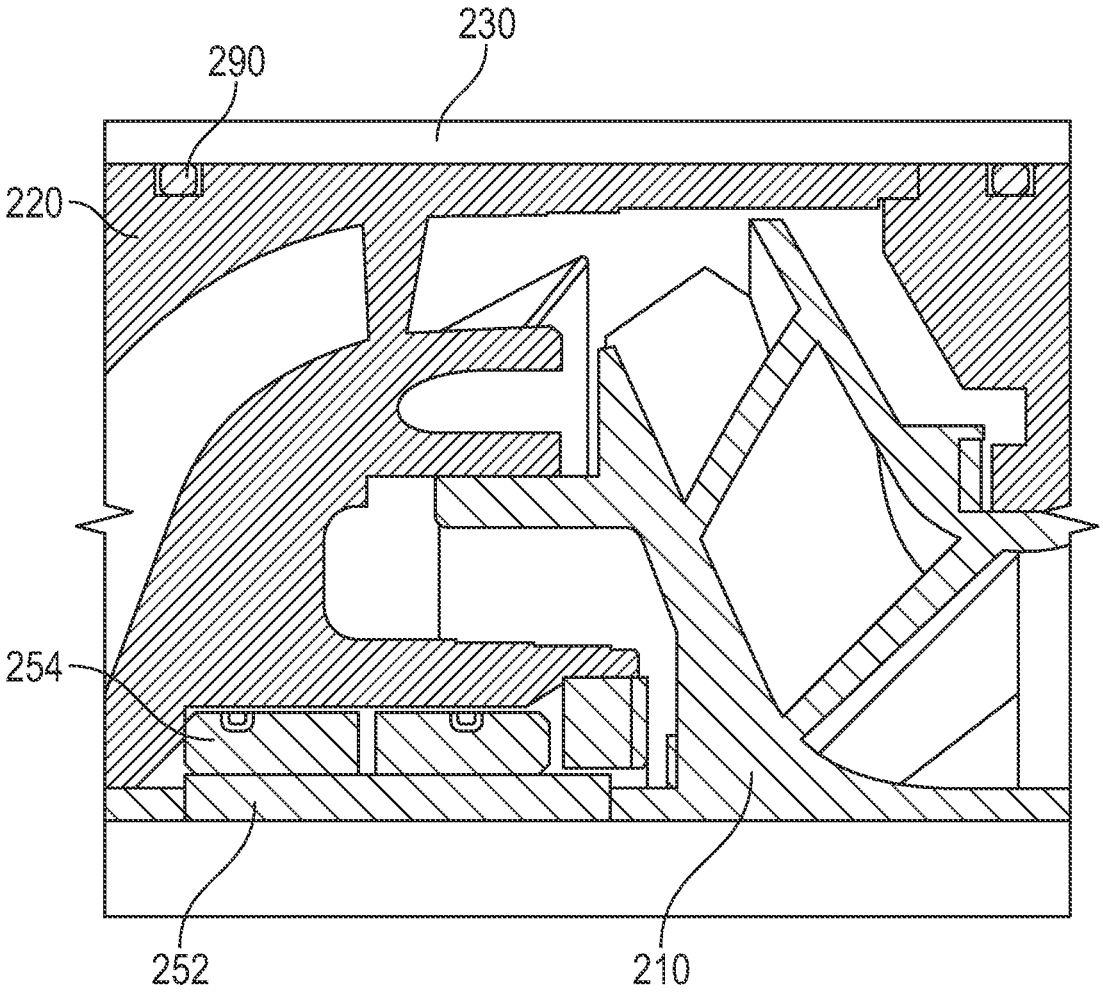
FIG. 3 shows a partial cross-section of a portion of a pump section of an ESP.

In a typical downhole pump, the maximum number of stages within a section of the pump is typically limited because the first, or lowest, set of diffusers at the pump inlet 114 are not able to withstand the combined axial thrust and radial pressure loads generated by the stages stacked on top of them. Therefore, multiple short sections must be used instead of a single long section pump, which can increase the cost per foot of lift. To address this lower diffuser collapse issue, O-ring seals 290 are often used to seal the annular region between the OD of the diffuser 220 and the ID of the housing 230, for example as shown in FIG. 3. The O-ring seals 290 prevent or inhibit high pressure fluid from the top section of the pump migrating to the lower section of the pump, thereby reducing the stress induced within the lower diffuser.

However, pumps including O-ring seals 290 can be difficult to manufacture. During assembly, the O-ring 290 is installed on the OD of the diffuser 220. Then the diffuser 220 and O-ring 290 in a compressed state are pushed through the threads at the end of the housing 230 and must travel through the ID of the housing 230 until the diffuser 220 reaches its desired position within the pump housing 230. In some cases, the diffuser 220 and O-ring 290 must travel a distance in the range of 10-20 feet to reach the desired position.

To properly function as a seal, the O-ring 290 must be squeezed against the ID of the housing 230. The O-ring 290 can therefore be damaged by sharp threads on the housing 230 or rubbed and/or extruded against the ID of the housing 230 during assembly. Assembly can become more complicated and/or have a higher likelihood of damage to the O-rings 290 if multiple stages include O-rings 290. The process of pushing multiple sets of compressed O-rings 290 through long sections of the housing 230 can generate significant friction force, making the manual assembly operation difficult.

Figure 5:
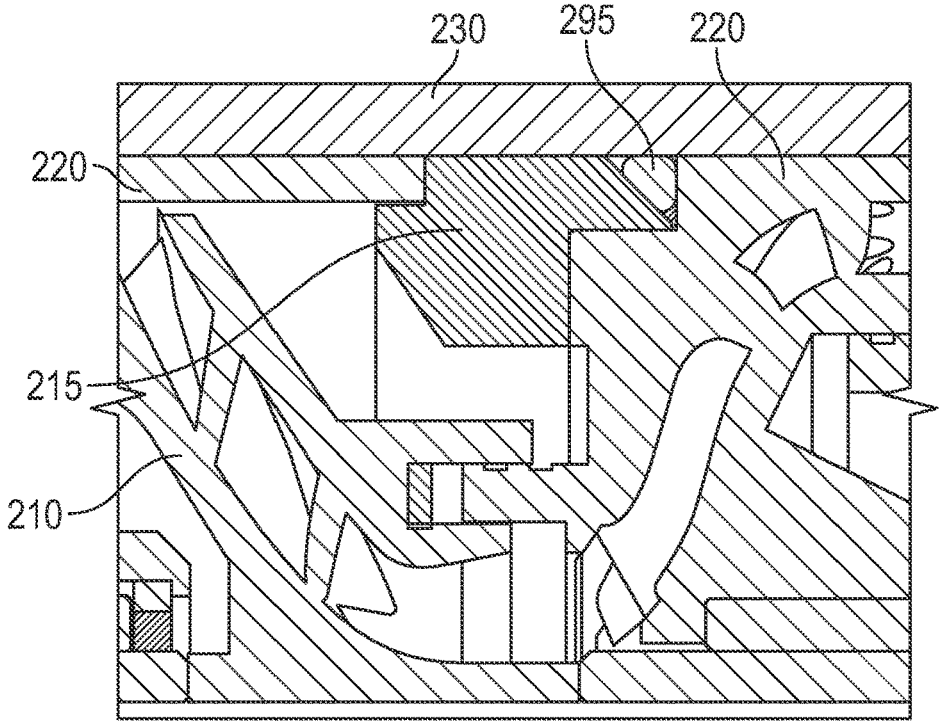
FIG. 5 shows a partial cross-section of the portion of the pump of FIG. 4 with the O-ring in a compressed state.

The present disclosure provides a crush type seal design and an independent sealing ring stacking along with the pump stages, for example as shown in FIG. 5. With designs according to the present disclosure, it is advantageously not necessary for O-rings to be squeezed or compressed prior to pushing the stages within the pump housing 230. Instead, the seals are activated once set in their desired locations when the stages are compressed.

Figure 4:
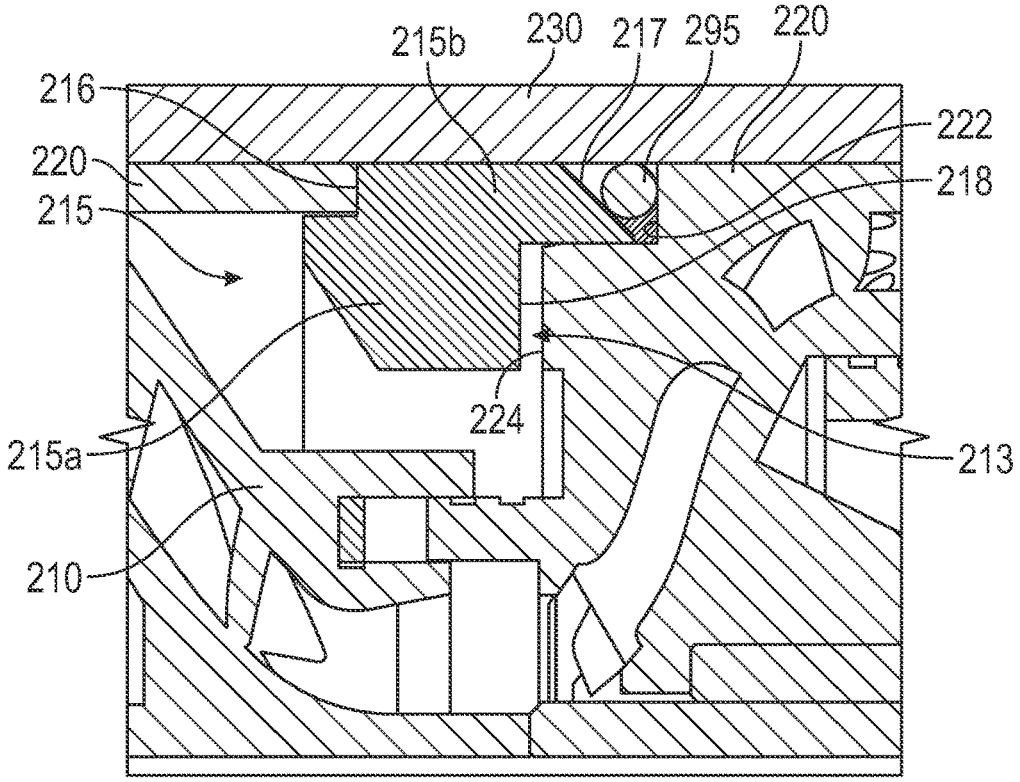
FIG. 4 shows a partial cross-section of a portion of a pump section of an ESP including an O-ring according to the present disclosure.

FIG. 4 shows a portion of a pump according to the present disclosure. As shown, a sealing ring 215 is disposed axially between adjacent or sequential diffusers 220 and adjacent and/or in contact with the ID of the housing 230. In some configurations, the sealing ring 215 has a radially inner portion 215*a* and a radially outer portion 215*b*. The radially inner portion 215*a* has a lower surface 218. The radially outer portion 215*b* has a flat upper edge or surface 216 (in other words, edge 216 extends perpendicularly to the longitudinal axis of the pump) and an angled or inclined lower edge or surface 217. The lower edge 217 can be angled such that a radially inner corner or side of the radially outer portion 215*b* extends lower, or further upstream, than a radially outer corner or side of the radially outer portion 215*b*.

An O-ring 295 is positioned axially between the sealing ring 215 and the adjacent or next lower diffuser 220. In the illustrated configuration, the O-ring 295 is positioned axially between the lower edge 217 and an upward facing surface or top face 222 of the adjacent or next lower diffuser 220. In some configurations, a pump includes a plurality of sealing rings 215, each positioned axially between a pair of consecutive diffusers, and a plurality of O-rings 295, each positioned axially between one of the sealing rings 215 and the next lower adjacent or consecutive diffuser 220.

In an initial, uncompressed state, the O-ring 295 is uncompressed, and a gap 213 is formed between the lower surface 218 of the radially inner portion 215*a* of the sealing ring 215 and an upward facing surface 224 of the adjacent, next lower diffuser 220. During assembly, there may be a relatively small amount of friction generated due to the axial force of pushing the stage stack into the housing 230. However, the O-ring 295 remains generally or mostly free from any compression or squeeze, and any friction generated is considerably lower than the friction force generated during assembly of pumps such as shown in FIG. 3.

Once the diffuser 220 and sealing ring 215 are pushed into the correct or desired position within the housing 230, stage compression is applied. Stage compression can bring surface 218 into contact with surface 224, closing the gap 213, as shown in FIG. 5. Stage compression also compresses the O-ring 295, as also shown in FIG. 5. As the O-ring 295 has a constant volume, the outer diameter of the O-ring 295 will expand or morph until the O-ring 295 OD squeezes against the ID of the housing 230, the diffuser top face 222, and the sealing ring 215 lower edge or inclined bottom face 217. The O-ring 295 sealing against the inner surface of the housing 230 prevents or inhibits pressure from above the seal from leaking below the seal through the diffuser-housing annulus. This sealing and pressure leak inhibition will eventually reduce radial pressure and/or stress on the diffusers below the seal location.

With the design of FIGS. 4-5, it is advantageously easier to manually push the diffuser stack with the O-rings 295 into the housing 230 as there is no, or reduced, friction force due to the O-rings 295 not being squeezed or compressed against the housing ID while pushing into the housing 230. The lack of or reduced friction due to absence of O-ring compression/squeeze reduces the likelihood of damage to the O-rings 295. The O-rings 295 are also less likely to be damaged by threads on the housing 230, even if the minor thread diameter is the same as or close to the housing inner diameter, as the O-rings 295 are not squeezed against the housing ID during assembly prior to compression. Designs according to the present disclosure also advantageously allow for the use of larger cross-section O-rings, thereby improving the sealing reliability. Designs according to the present disclosure can advantageously allow for longer section pumps, which can in turn generate higher lift and help decrease the cost per foot of lift.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric submersible pump comprising:

a plurality of impellers;

a plurality of diffusers including a first diffuser and a second diffuser, the second diffuser being lower than the first diffuser in an axial direction;

a sealing ring positioned axially between the first diffuser and the second diffuser, the sealing ring including:

a first surface disposed on an upper side of the sealing ring, wherein the first surface contacts a lower side of the first diffuser;

a second surface disposed on a lower side of the sealing ring, wherein the second surface contacts an upper side of the second diffuser; and a third surface disposed on the lower side of the sealing ring, wherein the third surface is angled with respect to the second surface; and an O-ring positioned axially between the third surface of the sealing ring and the upper side of the second diffuser.

2. The electric submersible pump of claim 1, wherein the plurality of impellers, the first and second diffusers, the sealing ring, and the O-ring are disposed in a housing of the electric submersible pump.

3. The electric submersible pump of claim 2, wherein the O-ring is compressed against an inner surface of the housing and the O-ring seals against the inner surface of the housing to reduce stress on the second diffuser.

4. The electric submersible pump of claim 1, comprising a second sealing ring positioned axially between a third diffuser and a fourth diffuser, the fourth diffuser being lower than the third diffuser in the axial direction, and a second O-ring positioned axially between second sealing ring and the fourth diffuser.

5. The electric submersible pump of claim 1, wherein the sealing ring comprises a radially inner portion and a radially outer portion.

6. The electric submersible pump of claim 5, the radially outer portion includes the third surface.

7. A method of assembling an electric submersible pump, the method comprising:

positioning a sealing ring axially between a first diffuser and a second diffuser such that a first surface disposed on an upper side of the sealing ring contacts a lower side of the first diffuser, and a gap is formed axially between a second surface disposed on a lower side of the sealing ring and an upper side of the second diffuser;

positioning an uncompressed O-ring axially between a third surface of the sealing ring and the second diffuser, wherein the third surface is disposed on the lower side of the sealing ring and is angled with respect to the second surface;

sliding the first and second diffusers, the sealing ring, and the uncompressed O-ring into a housing to a desired position; and applying stage compression to close the gap, thereby compressing the uncompressed O-ring to create a seal that prevents or inhibits leakage of fluid.

8. The method of claim 7, comprising:

positioning a second sealing ring axially between a third diffuser and a fourth diffuser, wherein the fourth diffuser is lower than the third diffuser;

positioning a second uncompressed O-ring axially between the second sealing ring and the fourth diffuser; and sliding the third and fourth diffusers, the second sealing ring, and the second uncompressed O-ring into the housing to the desired position.

9. A electric submersible pump system comprising:

an electric submersible pump comprising:

a housing;

a plurality of impellers;

a plurality of diffusers including a first diffuser and a second diffuser, the second diffuser being lower than the first diffuser in an axial direction;

a sealing ring positioned axially between the first diffuser and the second diffuser, the sealing ring including:

a first surface disposed on an upper side of the sealing ring, wherein the first surface contacts a lower side of the first diffuser;

a second surface disposed on a lower side of the sealing ring, wherein the second surface contacts an upper side of the second diffuser; and a third surface disposed on the lower side of the sealing ring, wherein the third surface is angled with respect to the second surface;

an O-ring positioned axially between the third surface of the sealing ring and the upper side of the second diffuser;

a shaft extending axially through the electric submersible pump;

a protector; and a motor.

10. The system of claim 9, wherein the O-ring is in an uncompressed state as the plurality of impellers, the first and second diffusers, the sealing ring, and the O-ring are slid into the housing during assembly.

11. The system of claim 10, wherein the O-ring is compressed against an inner surface of the housing.

12. The system of claim 9, wherein the sealing ring comprises a radially inner portion and a radially outer portion.

* * * * *